US008592012B2

(12) United States Patent
Noguchi et al.

(10) Patent No.: US 8,592,012 B2
(45) Date of Patent: Nov. 26, 2013

(54) RECORDING MEDIUM

(71) Applicant: Canon Kabushiki Kaisha, Tokyo (JP)

(72) Inventors: Tetsuro Noguchi, Hachioji (JP); Hisao Kamo, Ushiku (JP); Yasuhiro Nito, Yokohama (JP); Ryo Taguri, Sagamihara (JP); Isamu Oguri, Yokohama (JP); Olivia Herlambang, Kawasaki (JP); Naoya Hatta, Kawasaki (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/660,713

(22) Filed: Oct. 25, 2012

(65) Prior Publication Data

US 2013/0108809 A1 May 2, 2013

(30) Foreign Application Priority Data

Oct. 28, 2011 (JP) ..... 2011-237516

(51) Int. Cl.
*B41M 5/00* (2006.01)
*B41M 5/52* (2006.01)
*B41M 5/50* (2006.01)

(52) U.S. Cl.
CPC ..... *B41M 5/5254* (2013.01); *B41M 5/52* (2013.01); *B41M 5/506* (2013.01); *B41M 5/5218* (2013.01)
USPC ..... 428/32.24; 428/32.25; 428/32.26; 428/32.28; 428/32.31; 428/32.34

(58) Field of Classification Search
CPC ..... B41M 5/5254; B41M 5/52; B41M 5/506; B41M 5/5218
USPC ..... 428/32.24, 32.25, 32.26, 32.28, 32.31, 428/32.34
See application file for complete search history.

(56) References Cited

U.S. PATENT DOCUMENTS

| | | | | |
|---|---|---|---|---|
| 2006/0182903 | A1* | 8/2006 | Sakaguchi et al. | 428/32.24 |
| 2009/0214805 | A1 | 8/2009 | Kobayashi | |
| 2010/0075045 | A1 | 3/2010 | Kaimoto | |

FOREIGN PATENT DOCUMENTS

| | | | |
|---|---|---|---|
| JP | 2004-001528 | A | 1/2004 |

* cited by examiner

*Primary Examiner* — Betelhem Shewareged
(74) *Attorney, Agent, or Firm* — Canon USA Inc. IP Division

(57) ABSTRACT

A recording medium includes, in sequence, a support, a first ink-receiving layer, and a second ink-receiving layer, in which the first ink-receiving layer contains at least one selected from an alumina, an alumina hydrate, and a fumed silica, a polyvinyl alcohol, and a boric acid, in which a mass ratio of a content of the boric acid in the first ink-receiving layer to a content of the polyvinyl alcohol in the first ink-receiving layer is 2.0% by mass or more and 7.0% by mass or less, in which the second ink-receiving layer contains a fumed silica, a polyvinyl alcohol, and a boric acid, and in which a mass ratio of a content of the boric acid in the second ink-receiving layer to a content of the polyvinyl alcohol in the second ink-receiving layer is 10.0% by mass or more and 30.0% by mass or less.

8 Claims, No Drawings

RECORDING MEDIUM

BACKGROUND OF THE INVENTION

1. Field of the Invention

The present invention relates to a recording medium.

2. Description of the Related Art

Known examples of recording media in which recording is performed with ink include recording media each including an ink-receiving layer on a support. Recent trends toward higher recording speed have required recording media having higher ink absorbency.

Japanese Patent Laid-Open No. 2004-1528 discloses a recording medium including a plurality of ink-receiving layers on a support. In the recording medium, a mass ratio of a content of the binder to a content of the pigment (binder-to-pigment ratio) of each of the ink-receiving layers is increased with increasing distance from the upper ink-receiving layer toward the lower ink-receiving layer, thereby improving the ink absorbency and the adhesion between the support and the ink-receiving layers.

SUMMARY OF THE INVENTION

In recent years, there have been increasing demands for photo books, photo albums, and so forth. Recording media used for photo books and photo albums are required to have the following properties: cracking by folding is less likely to occur in bookbinding processes, i.e., high resistance to cracking by folding, in addition to high ink absorbency and the inhibition of the occurrence of cracking after the coating of ink-receiving layers. A mechanism for the occurrence of cracking by folding in a process for producing a photo book or a photo album is described below.

An image is recorded on one surface of a first recording medium. A crease is made in the recording medium along the center line of the recording medium. In this case, a left-side surface is referred to as a left surface, and a right-side surface is referred to as a right surface, with respect to the crease. Similarly, an image is recorded on a second recording medium, and a crease is made. The back surface of the right surface of the first recording medium is bonded to the back surface of the left surface of the second recording medium. A plurality of recording media are subjected to the same operation, thereby producing a photo book or a photo album that may use a double-page spread centered on the crease of each of the recording media. In this production process, when an image extending from one page to a subsequent page is recorded on a recording medium, a phenomenon in which the image is cracked along the crease, i.e., cracking of the image by folding, occurs.

It was found from studies by the inventors that the recording medium disclosed in Japanese Patent Laid-Open No. 2004-1528 does not have sufficient resistance to cracking by folding.

Accordingly, aspects of the present invention can provide a recording medium configured to inhibit the occurrence of cracking after the coating of the ink-receiving layers and to have high ink absorbency and high resistance to cracking by folding.

According to one aspect of the present invention, a recording medium includes, in sequence, a support, a first ink-receiving layer, and a second ink-receiving layer, in which the first ink-receiving layer contains at least one selected from an alumina, an alumina hydrate, and a fumed silica, a polyvinyl alcohol, and a boric acid, in which a mass ratio of a content of the boric acid in the first ink-receiving layer to a content of the polyvinyl alcohol in the first ink-receiving layer is 2.0% by mass or more and 7.0% by mass or less, in which the second ink-receiving layer contains a fumed silica, a polyvinyl alcohol, and a boric acid, and in which a mass ratio of a content of the boric acid in the second ink-receiving layer to a content of the polyvinyl alcohol in the second ink-receiving layer is 10.0% by mass or more and 30.0% by mass or less.

Further features of the present invention will become apparent from the following description of exemplary embodiments.

DESCRIPTION OF THE EMBODIMENTS

A recording medium according to aspects of the present invention will be described in detail below.

The recording medium according to aspects of the present invention includes a support, a first ink-receiving layer, and a second ink-receiving layer, in that order. The support is adjacent to the first ink-receiving layer. A surface of the first ink-receiving layer opposite the surface adjacent to the support is adjacent to the second ink-receiving layer.

Support

In aspects of the present invention, a water resistant support may be used as the support. Examples of the water resistant support include resin-coated paper in which a base paper is coated with a resin, synthetic paper, and plastic films. In particular, resin-coated paper may be used as the water resistant support.

An example of the base paper of resin-coated paper that may be used is plain paper commonly used. Smooth base paper used as a photographic support may be used. In particular, base paper which has been subjected to surface treatment in which compression is performed under pressure with, for example, a calender during papermaking or after papermaking and which has high surface smoothness may be used. Examples of a pulp constituting base paper include natural pulp, recycled pulp, and synthetic pulp. These pulps may be used separately or in combination as a mixture of two or more. The base paper may contain additives, such as a sizing agent, a paper-strengthening agent, a filler, an antistatic agent, a fluorescent whitener, and a dye, which are commonly used in papermaking. Furthermore, the base paper may be coated with, a surface-sizing agent, a surface-strengthening agent, a fluorescent whitener, an antistatic agent, a dye, and an anchoring agent.

The base paper may have a density of 0.6 g/cm$^3$ or more and 1.2 g/cm$^3$ or less and even 0.7 g/cm$^3$ or more. A density of 1.2 g/cm$^3$ or less results in the inhibition of reductions in cushioning properties and transport properties. A density of 0.6 g/cm$^3$ or more results in the inhibition of a reduction in surface smoothness.

The base paper may have a thickness of 50.0 μm or more. A thickness of 50.0 μm or more results in improvements in tensile strength, tear strength, and texture. The base paper may have a thickness of 350.0 μm or less in view of productivity and so forth. The thickness of the resin (resin layer) with which the base paper is coated may be 5.0 μm or more and even 8.0 μm or more, and may be 40.0 μm or less and even 35.0 μm or less. A thickness of 5.0 μm or more results in the inhibition of the penetration of water and gas into the base paper and the inhibition of cracking of the ink-receiving layers by folding. A thickness of 40.0 μm or less results in improvement in anticurl properties.

Examples of the resin that may be used include low-density polyethylene (LDPE) and high-density polyethylene (HDPE). In addition, linear low-density polyethylene (LLDPE) and polypropylene may be used.

In particular, for a resin layer located on the side (surface side) where the ink-receiving layers are formed, a rutile or anatase titanium oxide, a fluorescent whitener, and ultramarine blue may be added to polyethylene to improve opacity, brightness, and hues. In the case where the resin layer contains titanium oxide, a mass ratio of a content of the titanium oxide to the total mass of the resin may be 3.0% by mass or more and even 4.0% by mass or more, and may be 20.0% by mass or less and even 13.0% by mass or less.

Examples of the plastic film include films produced from thermoplastic resins, such as polyethylene, polypropylene, polystyrene, polyvinyl chloride, and polyester, and thermosetting resins, such as urea resins, melamine resins, and phenolic resins. The plastic film may have a thickness of 50.0 μm or more and 250.0 μm or less.

The water resistant support may have a predetermined surface state, such as a glossy surface, a semi-glossy surface, and a matt surface. In particular, the semi-glossy surface and the matt surface may be used. For example, when a resin is melt-extruded onto a surface of base paper to perform coating, embossing may be performed by bringing the surface of the resin into pressure contact with a roller having a patterned surface with irregularities to form the semi-glossy surface or the matt surface. In the case where the ink-receiving layers are formed on the support having the semi-glossy surface or the matt surface, irregularities reflecting the irregularities of the support are formed on a surface of the ink-receiving layer, i.e., on a surface of the recording medium. This inhibits glare due to excessively high gloss. The bonding area between the support and the ink-receiving layer is large, thus improving resistance to cracking by folding. The arithmetical mean roughness (Ra), complying with JIS B0601:2001, of the surface of the recording medium at a cutoff length of 0.8 mm may be 0.3 μm or more and 6.0 μm or less and even 0.5 μm or more and 3.0 μm or less. An arithmetical mean roughness of 0.3 μm to 6.0 μm results in satisfactory gloss.

In aspects of the present invention, a primer layer mainly composed of a hydrophilic polymer, e.g., a gelatin or polyvinyl alcohol, may be formed on the surface of the support where the ink-receiving layers are formed. Alternatively, adhesion-improving treatment, e.g., corona discharge or plasma treatment, may be performed. Thus, the adhesion between the support and the ink-receiving layer may be improved.

Ink-Receiving Layer

The ink-receiving layers according to aspects of the present invention include the first ink-receiving layer and the second ink-receiving layer. Each of the ink-receiving layers is a solidified product of a coating liquid configured to form an ink-receiving layer (hereinafter, referred to as an "ink-receiving layer coating liquid"). Each ink-receiving layer is formed by applying the ink-receiving layer coating liquid onto the water resistant support and drying the coating film. A total thickness of the first and second ink-receiving layers may be 15.0 μm or more, such as 20.0 μm or more, and even 25 μm or more, and may be 50.0 μm or less and even 40.0 μm or less. A total thickness of the ink-receiving layers of 15.0 μm or more and 50.0 μm or less results in a satisfactory optical density, ink absorbency, and resistance to cracking by folding. In aspects of the present invention, the total thickness of the ink-receiving layers may be 30.0 μm or more and 38.0 μm or less.

For the two ink-receiving layers, the first ink-receiving layer contains inorganic particles, a polyvinyl alcohol, and a boric acid, the inorganic particles comprising at least one compound selected from an alumina, an alumina hydrate, and a fumed silica. The second ink-receiving layer contains a fumed silica as inorganic particles, a polyvinyl alcohol, and a boric acid. These components will be described below.

Alumina

Examples of the alumina include a γ-alumina, an α-alumina, a δ-alumina, a θ-alumina, and a χ-alumina. Among these compounds, the γ-alumina may be used from the viewpoint of achieving a good optical density and ink absorbency. An example of the γ-alumina is a commercially available fumed γ-alumina (e.g., trade name: AEROXIDE Alu C, manufactured by EVONIK Industries).

Alumina Hydrate

The alumina hydrate represented by general formula (X) may be used:

$$Al_2O_{3-n}(OH)_{2n}\cdot mH_2O \quad (X)$$

wherein n represents 0, 1, 2, or 3, and m represents a value of 0 or more and 10 or less and may be 0 or more and 5 or less, with the proviso that m and n are not zero at the same time, m may represent an integer value or not an integer value because $mH_2O$ often represents detachable water that does not participate in the formation of a crystal lattice, and m may reach zero when the alumina hydrate is heated.

Known crystal structures of the alumina hydrate include amorphous, gibbsite, and boehmite, depending on heat-treatment temperature. An alumina hydrate having any of these crystal structures may be used. In particular, an alumina hydrate having a boehmite structure or an amorphous structure determined by X-ray diffraction analysis may be used. Specific examples of the alumina hydrate include alumina hydrates described in, for example, Japanese Patent Laid-Open Nos. 7-232473, 8-132731, 9-66664, and 9-76628. Specific examples of the shape of the alumina hydrate used in aspects of the present invention include indefinite shapes; and definite shapes, such as spherical and plate-like shapes. Any of the indefinite shapes and the definite shapes may be used. Alternatively, they may be used in combination. In particular, an alumina hydrate whose primary particles have a number-average particle size of 5 nm or more and 50 nm or less may be used. A plate-like alumina hydrate having an aspect ratio of 2 or more may be used. The aspect ratio may be determined by a method described in Japanese Patent Publication No. 5-16015. That is, the aspect ratio is expressed as the ratio of the diameter to the thickness of a particle. The term "diameter" used here indicates the diameter (circle-equivalent diameter) of a circle having an area equal to the projected area of each alumina hydrate particle when the alumina hydrate is observed with a microscope or an electron microscope.

In aspects of the present invention, the specific surface area of the alumina hydrate determined by the Brunauer-Emmett-Teller (BET) method, i.e., BET specific surface area, may be 100 $m^2/g$ or more and 200 $m^2/g$ or less and even 125 $m^2/g$ or more and 190 $m^2/g$ or less. The BET method employed here indicates a method in which molecules or ions each having a known size are allowed to adsorb on surfaces of a sample and the specific surface area of the sample is determined from the amount of the molecules or ions adsorbed. In aspects of the present invention, nitrogen gas is used as a gas to be adsorbed on the sample.

The alumina hydrate may be produced by a known method, for example, a method in which an aluminum alkoxide is hydrolyzed or a method in which sodium aluminate is hydrolyzed, as described in U.S. Pat. Nos. 4,242,271 and 4,202,870. Alternatively, the alumina hydrate may also be produced by a known method, for example, a method in which an aqueous solution of sodium aluminate is neutralized by the addition of an aqueous solution of aluminum sulfate, aluminum chloride, or the like. Specific examples of the alumina hydrate used in aspects of the present invention include alumina hydrates having a boehmite structure and amorphous structure, which are determined by X-ray diffraction analysis. In particular, examples thereof include the alumina hydrates described in Japanese Patent Laid-Open Nos. 7-232473, 8-132731, 9-66664, and 9-76628. Furthermore, a specific example of the alumina hydrate is a commercially available alumina hydrate (for example, trade name: DISPERAL HP14, manufactured by Sasol).

The alumina and the alumina hydrate may be used in combination as a mixture. In the case of mixing of the alumina and the alumina hydrate, a powdery alumina and a powdery alumina hydrate may be mixed and dispersed to prepare a dispersion (sol). Alternatively, an alumina dispersion and an alumina hydrate dispersion may be mixed together.

Fumed Silica

The fumed silica indicates a silica produced by the combustion of silicon tetrachloride, hydrogen, and oxygen, and is also referred to as dry process silica. An example of the fumed silica is a commercially available fumed silica (e.g., trade name: AEROSIL 300, manufactured by EVONIK industries).

The fumed silica may have a BET specific surface area of 50 $m^2/g$ or more and even 200 $m^2/g$ or more, and may be 400 $m^2/g$ or less and even 350 $m^2/g$ or less from the viewpoint of achieving good ink absorbency, optical density, and resistance to cracking during coating and drying. The BET specific surface area is determined in the same way as the alumina hydrate described above.

Polyvinyl Alcohol

An example of the polyvinyl alcohol is a common polyvinyl alcohol produced by hydrolysis of a polyvinyl acetate. The polyvinyl alcohol may have a viscosity-average polymerization degree of 2000 or more and 4500 or less and even 3000 or more and 4000 or less. A viscosity-average polymerization degree of 2000 or more and 4500 or less results in improvements in ink absorbency, optical density, and resistance to cracking by folding, and results in the inhibition of occurrence of cracking at the time of coating. The polyvinyl alcohol may be a partially or completely saponified polyvinyl alcohol. The polyvinyl alcohol may have a saponification degree of 85% by mole or more and 100% by mole or less. An example of the polyvinyl alcohol is PVA 235 (manufactured by Kuraray Co., Ltd., saponification degree: 88% by mole, average degree of polymerization: 3500).

In the case where the polyvinyl alcohol is incorporated into the ink-receiving layer coating liquid, the polyvinyl alcohol may be contained in an aqueous solution. A polyvinyl alcohol-containing aqueous solution may have a polyvinyl alcohol concentration of 4.0% by mass or more and 15.0% by mass or less in terms of solid content. A polyvinyl alcohol concentration of 4.0% by mass or more and 15.0% by mass results in the inhibition of a significant reduction in drying rate due to an excessive reduction in the concentration of the coating liquid, and results in the inhibition of a decrease in smoothness due to a significant increase in the viscosity of the coating liquid caused by an increase in the concentration of the coating liquid.

Each of the ink-receiving layers may optionally also contain a binder other than the polyvinyl alcohol. To sufficiently provide advantageous effects of aspects of the present invention, a content of the binder other than the polyvinyl alcohol may be 50.0% by mass or less with respect to the total mass of the polyvinyl alcohol.

Boric Acid

Examples of the boric acid include an orthoboric acid ($H_3BO_3$), a metaboric acid, and a hypoboric acid. These compounds may be used in the form of borates. Examples of the borates include orthoborates, such as $InBO_3$, $ScBO_3$, $YBO_3$, $LaBO_3$, $Mg_3(BO_3)_2$, and $Co_3(BO_3)_2$); diborates, such as $Mg_2B_2O_5$ and $Co_2B_2O_5$; metaborates, such as $LiBO_2$, $Ca(BO_2)_2$, $NaBO_2$, and $KBO_2$); tetraborates, such as $Na_2B_4O_7.10H_2O$; pentaborates, such as $KB_5O_8.4H_2O$, $Ca_2B_6O_{11}$-$7H_2O$, and $CsB_5O_5$; and hydrates thereof. Among these borates, the orthoboric acid may be used in view of the temporal stability of the coating liquid. In aspects of the present invention, a content of the orthoboric acid in the total mass of the boric acid may be 80% by mass or more and 100% by mass or less and even 90% by mass or more and 100% by mass or less.

In the case where the boric acid is incorporated into the ink-receiving layer coating liquid, the boric acid may be contained in an aqueous solution. A boric acid-containing aqueous solution may have a solid content of 0.5% by mass or more and 8.0% by mass or less. A boric acid concentration of 0.5% by mass or more and 8.0% by mass or less results in the inhibition of a significant reduction in drying rate due to a reduction in the concentration of the coating liquid, and results in the inhibition of the precipitation of the boric acid.

Additive

Each of the first and second ink-receiving layers may optionally also contain an additive. Examples of the additive include fixing agents, such as cationic resins; flocculants, such as multivalent metal salts; surfactants; fluorescent whiteners; thickeners; antifoaming agents: foam inhibitors; release agents; penetrants; lubricants; ultraviolet absorbers; antioxidants; leveling agents; preservatives; and pH regulators.

The relationship between the first ink-receiving layer and the second ink-receiving layer will be described below.

Relationship Between First Ink-Receiving Layer and Second Ink-Receiving Layer

A traditional ink-receiving layer containing a cross-linking agent, such as boric acid, in addition to inorganic particles and polyvinyl alcohol contains a relatively large amount of the cross-linking agent. Thus, such an ink-receiving layer often has a high degree of cross-linking. In this case, cracking occurring during coating or drying (after coating) is likely to be effectively inhibited, thereby providing an ink-receiving layer having satisfactory ink absorbency. However, the resulting ink-receiving layer is hard and brittle because of its high degree of cross-linking, so that, in particular, the ink-receiving layer sometimes has low resistance to cracking by folding.

In the case where no cross-linking agent is contained, cracking occurring after coating is pronounced to reduce the ink absorbency. In addition, the resistance to cracking by folding, which is considered to be high because no cross-linking agent is contained, is sometimes low. The reason for this is not clear but is probably that in the case where none of the polyvinyl alcohol molecules is cross-linked, cohesive bonds among the polyvinyl alcohol, the inorganic particles, and water resistant support are weakened.

The inventors have conducted intensive studies and have found the following: The resistance to cracking by folding of the ink-receiving layers is affected by the adhesion between the water resistant support and the first ink-receiving layer or between the first ink-receiving layer and the second ink-receiving layer. The resistance to cracking by folding of the ink-receiving layers is also affected by flexibility of the ink-receiving layers. When the polyvinyl alcohol in the first ink-receiving layer and the second ink-receiving layer adjacent to the water resistant support is cross-linked in a certain range, satisfactory resistance to cracking by folding is provided.

There is the optimal cross-linking range of the polyvinyl alcohol from the viewpoint of achieving good resistance to cracking by folding. In this range, however, cracking after coating occurs, and the ink absorbency is reduced, in some cases. Accordingly, the inventors have found that the degree of cross-linking of each of the two ink-receiving layers is specified to increase the cracking resistance after coating, ink absorbency, and resistance to cracking by folding. This finding has led to the completion of aspects of the present invention.

In aspects of the present invention, a mass ratio of a content of the boric acid to a content of the polyvinyl alcohol in the first ink-receiving layer is 2.0% by mass or more and 7.0% by mass or less. A content of the boric acid of 2.0% by mass or more and 7.0% by mass or less results in satisfactory contact between the water resistant support and the first ink-receiving layer, thereby inhibiting the occurrence of cracking after coating and increasing the resistance to cracking by folding. The mass ratio of the content of the boric acid to the content of the polyvinyl alcohol in the first ink-receiving layer may be 3.0% by mass or more and 6.5% by mass or less.

The first ink-receiving layer contains inorganic particles comprising at least one compound selected from an alumina, an alumina hydrate, and a fumed silica. The alumina hydrate has a high surface density of hydroxy groups and high bonding strength to the polyvinyl alcohol, compared with the fumed silica and the alumina. The first ink-receiving layer may have a content of the alumina hydrate of 50.0% by mass or more, such as 80% by mass or more, and even 100% by mass, i.e., the inorganic particles contain the alumina hydrate alone, with respect to the total mass of the inorganic particles in view of the resistance to cracking by folding.

A mass ratio of the content of polyvinyl alcohol to a content of the inorganic particle in the first ink-receiving layer may be 11.0% by mass or more and 40.0% by mass or less and even 12.0% by mass or more and 30.0% by mass or less. A content of the polyvinyl alcohol of 11.0% by mass or more and 40.0% by mass or less results in the enhancement of the inhibition of cracking after coating and results in improvements in ink absorbency and resistance to cracking by folding.

A mass ratio of the content of the boric acid to the content of the polyvinyl alcohol in the second ink-receiving layer is higher than that in the first ink-receiving layer. The mass ratio of the content of the boric acid to the content of the polyvinyl alcohol in the second ink-receiving layer is not simply increased but is 10.0% by mass or more and 30.0% by mass or less. When the content of the boric acid falls within the range described above, the second ink-receiving layer has an appropriately high degree of cross-linking of the polyvinyl alcohol, compared with the first ink-receiving layer. Thus, even if ink droplets land, the polyvinyl alcohol is less likely to swell, thereby providing high ink absorbency and improving the resistance to cracking during coating and drying. A mass ratio of the content of the boric acid to the content of the polyvinyl alcohol in the second ink-receiving layer may be 12.0% by mass or more and 25.0% by mass or less.

A mass ratio of the content of the polyvinyl alcohol to a content of the inorganic particles in the second ink-receiving layer may be 12.0% by mass or more and 20.0% by mass or less and even 13.0% by mass or more and 18.0% by mass or less. A content of the polyvinyl alcohol of 12.0% by mass or more and 20.0% by mass or less results in the enhancement of the inhibition of cracking after coating and results in improvements in ink absorbency and resistance to cracking by folding, in combination with the structure of the first ink-receiving layer. The second ink-receiving layer contains a fumed silica as the inorganic particles. The second ink-receiving layer may have a content of the fumed silica of 90% by mass or more and even 100% by mass with respect to the total mass of the inorganic particles.

A thickness of the second ink-receiving layer may be 5.0 μm or more and 20.0 μm or less and even 7.0 μm or more and 15.0 μm or less. A thickness of the first ink-receiving layer may be 20.0 μm or more and 40.0 μm or less and even 20.0 μm or more and 28.0 μm or less. The thickness ratio of the second ink-receiving layer to the first ink-receiving layer, i.e., second ink-receiving layer/first ink-receiving layer, may be 0.08 or more and 1.0 or less. A thickness ratio of 0.08 or more and 1.0 or less results in satisfactory resistance to cracking by folding, ink absorbency, and resistance to cracking during coating and drying.

While the ink-receiving layers according to aspects of the present invention are two layers, a thin film may be provided on top of the second ink-receiving layer, between the second ink-receiving layer and the first ink-receiving layer, or between the first ink-receiving layer and the support as long as advantageous effects of aspects of the present invention are not significantly impaired. A thickness of the thin film may be 0.1 μm or more and 3.0 μm or less. In particular, a colloidal silica-containing surface layer serving as the thin film may be provided on the second ink-receiving layer in view of glossiness and scratch resistance.

The term "thickness" used in aspects of the present invention indicates a thickness in an absolutely dry state, the thickness being defined as the average value of measurement values obtained by measuring the thicknesses at four points in a section with a scanning electron microscope. In aspects of the present invention, an object whose thickness is measured is set to a quadrangle. The four points are located at positions 1 cm from the four corners toward the center of gravity of the quadrangle.

Ink-Receiving Layer Coating Liquid

Sol Containing at Least One Compound Selected from Alumina and Alumina Hydrate

According to aspects of the present invention, the alumina or the alumina hydrate in the form of a dispersion in a deflocculated state due to a deflocculant may be added to the ink-receiving layer coating liquid. A dispersion containing the alumina hydrate deflocculated with the deflocculant is referred to as an alumina hydrate sol. A dispersion containing the alumina deflocculated with the deflocculant is referred to as an alumina sol. A sol containing at least one compound selected from the alumina and the alumina hydrate may further contain an acid serving as a deflocculant. In addition, the sol may further contain an additive, for example, a dispersion medium, a pigment dispersant, a thickener, a flow improver, an antifoaming agent, a foam inhibitor, a surfactant, a release agent, a penetrant, a color pigment, a color dye, a fluorescent whitener, an ultraviolet absorber, an antioxidant, a preservative, a fungicide, a water resistant additive, a dye fixing agent, a cross-linking agent, or a weatherproofer. Examples of the dispersion medium used for the sol containing at least one compound selected from the alumina and the alumina hydrate include water, organic solvents, and mixed solvent thereof. In particular, water may be used. In aspects of the present invention, an acid (deflocculating acid) may be used as a deflocculant. As the deflocculating acid, a monovalent sulfonic acid may be used from the viewpoint of achieving good ozone resistance of an image and inhibiting the blurring of an image in a high-humidity environment. Specific examples of the monovalent sulfonic acid include methanesulfonic acid, ethanesulfonic acid, 1-propanesulfonic acid, 2-propanesulfonic acid, 1-butanesulfonic acid, chloromethanesulfonic acid, dichloromethanesulfonic acid, trichloromethanesulfonic acid, trifluoromethanesulfonic acid, amidosulfonic acid, taurine, vinylsulfonic acid, aminomethanesulfonic acid, 3-amino-1-propanesulfonic acid, benzenesulfonic acid, hydroxybenzenesulfonic acid, and p-toluenesulfonic acid. These compounds may be used separately or in combination as a mixture.

The sol containing at least one compound selected from the alumina and the alumina hydrate may have a content of the deflocculating acid of 100 mmol to 500 mmol with respect to 1 kg of the total weight of the alumina hydrate and the alumina. A content of the deflocculating acid of 100 mmol or more results in the inhibition of a significant increase in the viscosity of the sol. A content of the deflocculating acid of 500 mmol or less results in the inhibition of the occurrence of bronzing and beading without saturating the deflocculating effect.

Sol Containing Fumed Silica

The fumed silica used in aspects of the present invention may be added to the ink-receiving layer coating liquid in a state in which the silica is dispersed in a dispersion medium. A dispersion containing a cation polymer serving as a mordant and the fumed silica dispersed therein is defined as a fumed silica sol. Examples of the cationic polymer include polyethyleneimine resins, polyamine resins, polyamide resins, polyamide-epichlorohydrin resins, polyamine-epichlorohydrin resins, polyamide-polyamine-epichlorohydrin resins, polydiallylamine resins, and dicyandiamide condensates. These cationic resins may be used separately or in combination. The fumed silica sol may contain a multivalent metal salt. Examples of the multivalent metal salt include aluminum compounds, such as poly(aluminum chloride), poly(aluminum acetate), and poly(aluminum lactate). The fumed silica sol may further contain an additive, for example, a surface modifier, such as a silane coupling agent, a thickener, a flow improver, an antifoaming agent, a foam inhibitor, a surfactant, a release agent, a penetrant, a color pigment, a color dye, a fluorescent whitener, an ultraviolet absorber, an antioxidant, a preservative, a fungicide, a water resistant additive, a cross-linking agent, or a weatherproofer. Examples of the dispersion medium for the fumed silica sol include water, organic solvents, and mixed solvents thereof. In particular, water may be used.

Method for Applying Ink-Receiving Layer Coating Liquid

In aspects of the present invention, the ink-receiving layer coating liquid is applied and dried to form an ink-receiving layer. The ink-receiving layer coating liquid may be applied by a known coating method. Examples of the coating method include a slot die method, a slide bead method, a curtain method, an extrusion method, an air-knife method, a roll coating method, and a rod-bar coating method. Coating liquids used for the first ink-receiving layer and the second ink-receiving layer may be applied and dried by sequential coating or may be applied by simultaneous multilayer coating. In particular, simultaneous multilayer coating may be performed by the slide bead method because of its high productivity.

Drying after coating is performed by a hot-air dryer, e.g., a linear tunnel dryer, an arch dryer, an air-loop dryer, or a sine-curve air float dryer, or a dryer using infrared rays, heating, microwaves, or the like.

EXAMPLES

While aspects of the present invention will be described below in more detail by examples and comparative examples, aspects of the present invention are not limited to these examples. Note that the term "part(s)" indicates part(s) by mass.

Production of Support

To a pulp containing 80 parts by mass of laubholz bleached kraft pulp (LBKP) having a freeness of 450 mL in terms of Canadian Standard Freeness (CSF) and 20 parts by mass of nadelholz bleached kraft pulp (NBKP) having a freeness of 480 mL in terms of CSF, 0.60 parts by mass of cationized starch, 10 parts by mass of heavy calcium carbonate, 15 parts by mass of precipitated calcium carbonate, 0.10 parts by mass of alkyl ketene dimer, and 0.03 parts by mass of cationic polyacrylamide were externally added. The mixture was adjusted with water so as to have a solid content of 3.0% by mass, thereby preparing a paper material. The resulting paper material was subjected to paper making with a Fourdrinier machine, in which three-stage wet pressing was performed, followed by drying with a multi-cylinder dryer. The resulting paper was impregnated with an aqueous solution of oxidized starch so as to have a coating weight of 1.0 g/m$^2$ with a size press, and then dried. The dry paper was subjected to machine calendering to provide a base paper having a basis weight of 155 g/m$^2$.

A resin composition containing a low-density polyethylene (70 parts), a high-density polyethylene (20 parts), and a titanium oxide (10 parts) was applied to the front surface of the base paper in an amount of 25 g/m$^2$, thereby forming a front-surface-covering resin layer.

Immediately after the coating of the front-surface-covering resin layer, embossing treatment was performed using a cooling roll having a surface with regular asperities to form a semi-glossy surface.

The arithmetical mean roughness (Ra), complying with JIS B0601:2001, of the surface of the front-surface-covering resin layer at a cutoff length of 0.8 mm was 1.8 μm.

Next, a resin composition containing a high-density polyethylene (50 parts) and a low-density polyethylene (50 parts) was applied to the back surface of the base paper in an amount of 30 g/m$^2$ to form a back-surface-covering resin layer, thereby providing resin-coated paper.

The front surface of the resin-coated paper was subjected to corona discharge. Then acid-treated gelatin was applied in a coating weight of 0.05 g/m$^2$ in terms of solid content, thereby forming an adhesion-improving layer. The back surface of the resin-coated paper was subjected to corona discharge. A back layer containing about 0.4 g of a styrene-acrylate latex binder having a glass transition temperature (Tg) of about 80° C., 0.1 g of an antistatic agent (cationic polymer), and 0.1 g of a colloidal silica serving as a matting agent is formed by coating on the back surface, thereby providing the support.

Preparation of Alumina Hydrate Sol

First, 1.5 parts of methanesulfonic acid serving as a deflocculating acid was added to 333 parts of deionized water. Then 100 parts of an alumina hydrate (trade name: DISPERAL HP14, manufactured by Sasol) was gradually added to the resulting aqueous solution of methanesulfonic acid under stirring at 3000 rpm with a homomixer (trade name: T.K. Homomixer MARK II Model 2.5, manufactured by Tokushu Kika Kogyo Co., Ltd). After the completion of the addition, the mixture was stirred for another 30 minutes to prepare an alumina hydrate sol having a solid content of 23% by mass.

Preparation of Alumina Sol

First, 1.5 parts of methanesulfonic acid serving as a deflocculating acid was added to 333 parts of deionized water. Then 100 parts of an alumina (trade name: AEROXIDE Alu C, manufactured by EVONIK Industries) was gradually added to the resulting aqueous solution of methanesulfonic acid under stirring at 3000 rpm with a homomixer (trade name: T.K. Homomixer MARK II Model 2.5, manufactured by Tokushu Kika Kogyo Co., Ltd). After the completion of the addition, the mixture was stirred for another 30 minutes to prepare an alumina sol having a solid content of 23% by mass.

Preparation of Fumed Silica Sol

First, 4.0 parts of a cationic polymer (Shallot DC-902P, manufactured by Dai-Ichi Kogyo Seiyaku Co., Ltd) was added to 333 parts of deionized water. Then 100 parts of a fumed silica (trade name: AEROSIL 300, manufactured by EVONIK Industries) was gradually added to the resulting aqueous solution of the cationic polymer under stirring at 3000 rpm with a homomixer (trade name: T.K. Homomixer MARK II Model 2.5, manufactured by Tokushu Kika Kogyo Co., Ltd). After the completion of the addition, the mixture was diluted with deionized water and was homogenized twice with a high-pressure homogenizer (Nanomizer, manufactured by Yoshida Kikai Co., Ltd.) to prepare a fumed silica sol having a solid content of 20% by mass.

Preparation of Aqueous Polyvinyl Alcohol Solution

First, 100 parts of a polyvinyl alcohol (PVA 235, manufactured by Kuraray Co., Ltd., saponification degree: 88% by mole, average degree of polymerization: 3500) was added to 1150 parts of deionized water under stirring. Then the polyvinyl alcohol was dissolved by heating at 90° C. to prepare an aqueous polyvinyl alcohol solution having a solid content of 8% by mass.

Production of Recording Medium 1

Second Ink-Receiving Layer Coating Liquid 1

The aqueous polyvinyl alcohol solution was mixed with the fumed silica sol in such a manner that the proportion of the polyvinyl alcohol in terms of solid content was 17 parts by mass with respect to 100 parts by mass of the solid content of the fumed silica in the fumed silica sol. An aqueous orthoboric acid solution having a solid content of 5% by mass was mixed with the resulting mixture in such a manner that the proportion of the orthoboric acid in terms of solid content was 17.6% by mass with respect to 100 parts by mass of the solid content of the polyvinyl alcohol in the mixture, thereby preparing a second ink-receiving layer coating liquid. A surfactant (trade name: Surfynol 465, manufactured by Nissin Chemical Industry Co., Ltd.) was added thereto in an amount of 0.1% by mass with respect to the total mass of the coating liquid, thereby preparing a second ink-receiving layer coating liquid 1.

First Ink-Receiving Layer Coating Liquid 1

The aqueous polyvinyl alcohol solution was mixed with the alumina hydrate sol in such a manner that the proportion of the polyvinyl alcohol in terms of solid content was 13 parts by mass with respect to 100 parts by mass of the solid content of the alumina hydrate. An aqueous orthoboric acid solution having a solid content of 5% by mass was mixed with the resulting mixture in such a manner that the proportion of the orthoboric acid in terms of solid content was 5.8% by mass with respect to 100 parts by mass of the solid content of the polyvinyl alcohol in the mixture, thereby preparing a first ink-receiving layer coating liquid 1.

Formation of Ink-Receiving Layer

The second ink-receiving layer coating liquid 1 and the first ink-receiving layer coating liquid 1 were applied to the front surface of the support with a multilayer slide hopper coater to form a total of two layers, i.e., one second ink-receiving layer and one first ink-receiving layer, in such a manner that the first ink-receiving layer had a dry thickness of 25 μm, the second ink-receiving layer formed on the first ink-receiving layer had a dry thickness of 10 μm, and a total thickness thereof was 35 μm. Subsequently, drying was performed at 60° C. to provide a recording medium 1.

Production of Recording Medium 2

A recording medium 2 was produced as in the recording medium 1, except that a first ink-receiving layer coating liquid 2 described below was used in place of the first ink-receiving layer coating liquid 1 for the recording medium 1.

First Ink-Receiving Layer Coating Liquid 2

The aqueous polyvinyl alcohol solution was mixed with the fumed silica sol in such a manner that the proportion of the polyvinyl alcohol in terms of solid content was 30 parts by mass with respect to 100 parts by mass of the solid content of the fumed silica. An aqueous orthoboric acid solution having a concentration of 5% by mass was mixed with the resulting mixture in such a manner that the proportion of the orthoboric acid in terms of solid content was 5.8% by mass with respect to 100 parts by mass of the solid content of polyvinyl alcohol in the mixture, thereby preparing the first ink-receiving layer coating liquid 2.

Production of Recording Medium 3

A recording medium 3 was produced as in the recording medium 1, except that a first ink-receiving layer coating liquid 3 described below was used in place of the first ink-receiving layer coating liquid 1 for the recording medium 1.

First Ink-Receiving Layer Coating Liquid 3

The alumina hydrate sol and the fumed silica sol were mixed together in such a manner that the ratio of alumina hydrate to fumed silica in terms of solid content was 25:75. The aqueous polyvinyl alcohol solution was mixed with the resulting mixed sol in such a manner that the proportion of the polyvinyl alcohol in terms of solid content was 25 parts by mass with respect to 100 parts by mass of the total solid content of the alumina hydrate and the fumed silica in the mixed sol. An aqueous orthoboric acid solution having a concentration of 5% by mass was mixed with the resulting mixture in such a manner that the proportion of the orthoboric acid in terms of solid content was 5.8% by mass with respect to 100 parts by mass of the solid content of the polyvinyl alcohol in the mixture, thereby preparing the first ink-receiving layer coating liquid 3.

Production of Recording Medium 4

A recording medium 4 was produced as in the recording medium 1, except that a first ink-receiving layer coating liquid 4 described below was used in place of the first ink-receiving layer coating liquid 1 for the recording medium 1.

First Ink-Receiving Layer Coating Liquid 4

The alumina hydrate sol and the fumed silica sol were mixed together in such a manner that the ratio of the alumina hydrate to the fumed silica in terms of solid content was 75:25. The aqueous polyvinyl alcohol solution was mixed with the resulting mixed sol in such a manner that the proportion of the polyvinyl alcohol in terms of solid content was 18 parts by mass with respect to 100 parts by mass of the total solid content of the alumina hydrate and the fumed silica in the mixed sol. An aqueous orthoboric acid solution having a concentration of 5% by mass was mixed with the resulting mixture in such a manner that the proportion of the orthoboric acid in terms of solid content was 5.8% by mass with respect to 100 parts by mass of the solid content of the polyvinyl alcohol in the mixture, thereby preparing the first ink-receiving layer coating liquid 4.

Production of Recording Medium 5

A recording medium 5 was produced as in the recording medium 1, except that a first ink-receiving layer coating liquid 5 described below was used in place of the first ink-receiving layer coating liquid 1 for the recording medium 1.

First Ink-Receiving Layer Coating Liquid 5

The alumina hydrate sol and the alumina sol were mixed together in such a manner that the ratio of the alumina hydrate to the alumina in terms of solid content was 75:25. The aqueous polyvinyl alcohol solution was mixed with the resulting mixed sol in such a manner that the proportion of polyvinyl alcohol in terms of solid content was 13 parts by mass with respect to 100 parts by mass of the total solid content of the alumina hydrate and the alumina in the mixed sol. An aqueous orthoboric acid solution having a concentration of 5% by mass was mixed with the resulting mixture in such a manner that the proportion of the orthoboric acid in terms of solid content was 5.8% by mass with respect to 100 parts by mass of the solid content of the polyvinyl alcohol in the mixture, thereby preparing the first ink-receiving layer coating liquid 5.

Production of Recording Medium 6

A recording medium 6 was produced as in the recording medium 1, except that a first ink-receiving layer coating liquid 6 described below was used in place of the first ink-receiving layer coating liquid 1 for the recording medium 1.

First Ink-Receiving Layer Coating Liquid 6

The alumina hydrate sol and the alumina sol were mixed together in such a manner that the ratio of the alumina hydrate to the alumina in terms of solid content was 25:75. The aqueous polyvinyl alcohol solution was mixed with the resulting mixed sol in such a manner that the proportion of the polyvinyl alcohol in terms of solid content was 13 parts by mass with respect to 100 parts by mass of the total solid content of the alumina hydrate and the alumina in the mixed sol. An aqueous orthoboric acid solution having a concentration of 5% by mass was mixed with the resulting mixture in such a manner that the proportion of the orthoboric acid in terms of solid content was 5.8% by mass with respect to 100 parts by mass of the solid content of the polyvinyl alcohol in the mixture, thereby preparing the first ink-receiving layer coating liquid 6.

Production of Recording Medium 7

A recording medium 7 was produced as in the recording medium 1, except that the application was performed in such a manner that the second ink-receiving layer had a dry thickness of 5 μm, the first ink-receiving layer had a dry thickness of 13 μm, and a total thickness thereof was 18 μm.

Production of Recording Medium 8

A recording medium 8 was produced as in the recording medium 1, except that the application was performed in such a manner that the second ink-receiving layer had a dry thickness of 6 μm, the first ink-receiving layer had a dry thickness of 16 μm, and a total thickness thereof was 22 μm.

Production of Recording Medium 9

A recording medium 9 was produced as in the recording medium 1, except that the application was performed in such a manner that the second ink-receiving layer had a dry thickness of 12 μm, the first ink-receiving layer had a dry thickness of 30 μm, and a total thickness thereof was 42 μm.

Production of Recording Medium 10

A recording medium 10 was produced as in the recording medium 1, except that the application was performed in such a manner that the second ink-receiving layer had a dry thickness of 13 μm, the first ink-receiving layer had a dry thickness of 32 μm, and a total thickness thereof was 45 μm.

Production of Recording Medium 11

A recording medium 11 was produced as in the recording medium 1, except that the application was performed in such a manner that the second ink-receiving layer had a dry thickness of 2.5 μm, the first ink-receiving layer had a dry thickness of 32.5 μm, and a total thickness thereof was 35 μm.

Production of Recording Medium 12

A recording medium 12 was produced as in the recording medium 1, except that the application was performed in such a manner that the second ink-receiving layer had a dry thickness of 5 μm, the first ink-receiving layer had a dry thickness of 30 μm, and a total thickness thereof was 35 μm.

Production of Recording Medium 13

A recording medium 13 was produced as in the recording medium 1, except that the application was performed in such a manner that the second ink-receiving layer had a dry thickness of 17.5 μm, the first ink-receiving layer had a dry thickness of 17.5 μm, and a total thickness thereof was 35 μm.

Production of Recording Medium 14

A recording medium 14 was produced as in the recording medium 1, except that the application was performed in such a manner that the second ink-receiving layer had a dry thickness of 20 μm, the first ink-receiving layer had a dry thickness of 15 μm, and a total thickness thereof was 35 μm.

Production of Recording Medium 15

A recording medium 15 was produced as in the recording medium 1, except that in the preparation of the second ink-receiving layer coating liquid 1 for the recording medium 1, the aqueous orthoboric acid solution having a concentration of 5% by mass was mixed in such a manner that the proportion of the orthoboric acid in terms of solid content was 10% by mass with respect to 100 parts by mass of the solid content of the polyvinyl alcohol.

Production of Recording Medium 16

A recording medium 16 was produced as in the recording medium 1, except that in the preparation of the second ink-receiving layer coating liquid 1 for the recording medium 1, the aqueous orthoboric acid solution having a concentration of 5% by mass was mixed in such a manner that the proportion of the orthoboric acid in terms of solid content was 30% by mass with respect to 100 parts by mass of the solid content of the polyvinyl alcohol.

Production of Recording Medium 17

A recording medium 17 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 10 parts by mass with respect to 100 parts by mass of the solid content of the fumed silica in the fumed silica sol.

Production of Recording Medium 18

A recording medium 18 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 12 parts by mass with respect to 100 parts by mass of the total solid content of the alumina hydrate and the alumina in the mixed sol.

Production of Recording Medium 19

A recording medium 19 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 20 parts by mass with respect to 100 parts by mass of the total solid content of the alumina hydrate and the alumina in the mixed sol.

Production of Recording Medium 20

A recording medium 20 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 22 parts by mass with respect to 100 parts by mass of the total solid content of the alumina hydrate and the alumina in the mixed sol.

Production of Recording Medium 21

A recording medium 21 was produced as in the recording medium 1, except that in the preparation of the first ink-receiving layer coating liquid 1 for the recording medium 1, the aqueous orthoboric acid solution having a solid content of 5% by mass was mixed in such a manner that the proportion of the orthoboric acid in terms of solid content was 2.3% by mass with respect to 100 parts by mass of the solid content of the polyvinyl alcohol.

Production of Recording Medium 22

A recording medium 22 was produced as in the recording medium 1, except that in the preparation of the first ink-receiving layer coating liquid 1 for the recording medium 1, the aqueous orthoboric acid solution having a solid content of 5% by mass was mixed in such a manner that the proportion of the orthoboric acid in terms of solid content was 6.9% by mass with respect to 100 parts by mass of the solid content of the polyvinyl alcohol.

Production of Recording Medium 23

A recording medium 23 was produced as in the recording medium 2, except that in the preparation of the first ink-receiving layer coating liquid 2 for the recording medium 2, the aqueous orthoboric acid solution having a solid content of 5% by mass was mixed in such a manner that the proportion of the orthoboric acid in terms of solid content was 2.3% by mass with respect to 100 parts by mass of the solid content of the polyvinyl alcohol.

Production of Recording Medium 24

A recording medium 24 was produced as in the recording medium 2, except that in the preparation of the first ink-receiving layer coating liquid 2 for the recording medium 2, the aqueous orthoboric acid solution having a solid content of 5% by mass was mixed in such a manner that the proportion of the orthoboric acid in terms of solid content was 7.0% by mass with respect to 100 parts by mass of the solid content of the polyvinyl alcohol.

Production of Recording Medium 25

A recording medium 25 was produced as in the recording medium 3, except that in the preparation of the first ink-receiving layer coating liquid 3 for the recording medium 3, the aqueous orthoboric acid solution having a solid content of 5% by mass was mixed in such a manner that the proportion of the orthoboric acid in terms of solid content was 2.4% by mass with respect to 100 parts by mass of the solid content of the polyvinyl alcohol.

Production of Recording Medium 26

A recording medium 26 was produced as in the recording medium 3, except that in the preparation of the first ink-receiving layer coating liquid 3 for the recording medium 3, the aqueous orthoboric acid solution having a solid content of 5% by mass was mixed in such a manner that the proportion of the orthoboric acid in terms of solid content was 6.8% by mass with respect to 100 parts by mass of the solid content of the polyvinyl alcohol.

Production of Recording Medium 27

A recording medium 27 was produced as in the recording medium 4, except that in the preparation of the first ink-receiving layer coating liquid 4 for the recording medium 4, the aqueous orthoboric acid solution having a solid content of 5% by mass was mixed in such a manner that the proportion of the orthoboric acid in terms of solid content was 2.2% by mass with respect to 100 parts by mass of the solid content of the polyvinyl alcohol.

Production of Recording Medium 28

A recording medium 28 was produced as in the recording medium 4, except that in the preparation of the first ink-receiving layer coating liquid 4 for the recording medium 4, the aqueous orthoboric acid solution having a solid content of 5% by mass was mixed in such a manner that the proportion of the orthoboric acid in terms of solid content was 6.7% by mass with respect to 100 parts by mass of the solid content of the polyvinyl alcohol.

Production of Recording Medium 29

A recording medium 29 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 10 parts by mass with respect to 100 parts by mass of the solid content of the alumina hydrate.

Production of Recording Medium 30

A recording medium 30 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 11 parts by mass with respect to 100 parts by mass of the solid content of the alumina hydrate.

Production of Recording Medium 31

A recording medium 31 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 40 parts by mass with respect to 100 parts by mass of the solid content of the alumina hydrate.

Production of Recording Medium 32

A recording medium 32 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 42 parts by mass with respect to 100 parts by mass of the solid content of the alumina hydrate.

Production of Recording Medium 33

A recording medium 33 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 10 parts by mass with respect to 100 parts by mass of the solid content of the fumed silica.

Production of Recording Medium 34

A recording medium 34 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 11 parts by mass with respect to 100 parts by mass of the solid content of the fumed silica.

Production of Recording Medium 35

A recording medium 35 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 40 parts by mass with respect to 100 parts by mass of the solid content of the fumed silica.

Production of Recording Medium 36

A recording medium 36 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 42 parts by mass with respect to 100 parts by mass of the solid content of the fumed silica.

Production of Recording Medium 37

A recording medium 37 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 10 parts by mass with respect to 100 parts by mass of the total solid content of the alumina hydrate and the fumed silica in the mixed sol.

Production of Recording Medium 38

A recording medium 38 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 11 parts by mass with respect to 100 parts by mass of the total solid content of the alumina hydrate and the fumed silica in the mixed sol.

Production of Recording Medium 39

A recording medium 39 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 40 parts by mass with respect to 100 parts by mass of the total solid content of the alumina hydrate and the fumed silica in the mixed sol.

Production of Recording Medium 40

A recording medium 40 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 42 parts by mass with respect to 100 parts by mass of the total solid content of the alumina hydrate and the fumed silica in the mixed sol.

Production of Recording Medium 41

A recording medium 41 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 10 parts by mass with respect to 100 parts by mass of the total solid content of the alumina hydrate and the fumed silica in the mixed sol.

Production of Recording Medium 42

A recording medium 42 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 11 parts by mass with respect to 100 parts by mass of the total solid content of the alumina hydrate and the fumed silica in the mixed sol.

Production of Recording Medium 43

A recording medium 43 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 40 parts by mass with respect to 100 parts by mass of the total solid content of the alumina hydrate and the fumed silica in the mixed sol.

Production of Recording Medium 44

A recording medium 44 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 42 parts by mass with respect to 100 parts by mass of the total solid content of the alumina hydrate and the fumed silica in the mixed sol.

Production of Recording Medium 45

A recording medium 45 was produced as in the recording medium 1, except that in the preparation of the second ink-receiving layer coating liquid 1 and the first ink-receiving layer coating liquid 1 for the recording medium 1, an aqueous solution of another polyvinyl alcohol (PVA 217, manufactured by Kuraray Co., Ltd., saponification degree: 88%, average degree of polymerization: 1700) (solid content: 8% by mass) was used in place of the aqueous polyvinyl alcohol solution.

Production of Recording Medium 46

A recording medium 46 was produced as in the recording medium 1, except that in the preparation of the second ink-receiving layer coating liquid 1 and the first ink-receiving layer coating liquid 1 for the recording medium 1, an aqueous solution of another polyvinyl alcohol (PVA 424, manufactured by Kuraray Co., Ltd., saponification degree: 80%, average degree of polymerization: 2400) (solid content: 8% by mass) was used in place of the aqueous polyvinyl alcohol solution.

Production of Recording Medium 47

A recording medium 47 was produced as in the recording medium 1, except that in the preparation of the second ink-receiving layer coating liquid 1 and the first ink-receiving layer coating liquid 1 for the recording medium 1, a mixed aqueous solution in which the ratio of the orthoboric acid to borax in terms of solid content was 75:25 and which had a total solid content of 5% by mass was used in place of the aqueous orthoboric acid solution having a solid content of 5% by mass.

Production of Recording Medium 48

A recording medium 48 was produced as in the recording medium 1, except that in the production of the support for the recording medium 1, a cooling roll having a surface without asperities was used in place of the cooling roll for the embossing treatment.

Production of Recording Medium 49

A recording medium 49 was produced as in the recording medium 1, except that in the production of the support for the recording medium 1, a cooling roll having a surface with larger asperities was used in place of the cooling roll for the embossing treatment.

Production of Recording Medium 50

A recording medium 50 was produced as in the recording medium 1, except that in the formation of the ink-receiving layer for the recording medium 1, only the second ink-receiving layer having a thickness of 35.0 μm was formed by coating without forming the first ink-receiving layer.

Production of Recording Medium 51

A recording medium 51 was produced as in the recording medium 1, except that in the formation of the ink-receiving layer for the recording medium 1, only the first ink-receiving layer having a thickness of 35.0 μm was formed by coating without forming the second ink-receiving layer.

Production of Recording Medium 52

A recording medium 52 was produced as in the recording medium 2, except that in the formation of the ink-receiving layer for the recording medium 2, only the first ink-receiving layer having a thickness of 35.0 μm was formed by coating without forming the second ink-receiving layer.

Production of Recording Medium 53

A recording medium 53 was produced as in the recording medium 3, except that in the formation of the ink-receiving layer for the recording medium 3, only the first ink-receiving layer having a thickness of 35.0 μm was formed by coating without forming the second ink-receiving layer.

Production of Recording Medium 54

A recording medium 54 was produced as in the recording medium 4, except that in the formation of the ink-receiving layer for the recording medium 4, only the first ink-receiving layer having a thickness of 35.0 μm was formed by coating without forming the second ink-receiving layer.

Production of Recording Medium 55

A recording medium 55 was produced as in the recording medium 1, except that in the formation of the ink-receiving layer for the recording medium 1, the second ink-receiving layer coating liquid 1 and the first ink-receiving layer coating liquid 1 were interchanged.

Production of Recording Medium 56

A recording medium 56 was produced as in the recording medium 1, except that in the formation of the ink-receiving layer for the recording medium 1, the aqueous orthoboric acid solution was not added to the second ink-receiving layer coating liquid 1 and the first ink-receiving layer coating liquid 1.

Production of Recording Medium 57

A recording medium 57 was produced as in the recording medium 1, except that in the formation of the ink-receiving layer for the recording medium 1, the aqueous orthoboric acid solution was not added to the first ink-receiving layer coating liquid 1.

Production of Recording Medium 58

A recording medium 58 was produced as in the recording medium 1, except that in the formation of the ink-receiving layer for the recording medium 1, the aqueous orthoboric acid solution was not added to the second ink-receiving layer coating liquid 1.

Production of Recording Medium 59

A recording medium 59 was produced as in the recording medium 1, except that in the preparation of the second ink-receiving layer coating liquid 1 for the recording medium 1, the aqueous orthoboric acid solution having a solid content of 5% by mass was mixed in such a manner that the proportion of the orthoboric acid in terms of solid content was 32.4% by mass with respect to 100 parts by mass of the solid content of the polyvinyl alcohol.

Production of Recording Medium 60

A recording medium 60 was produced as in the recording medium 1, except that in the preparation of the second ink-receiving layer coating liquid 1 for the recording medium 1, the aqueous orthoboric acid solution having a concentration of 5% by mass was mixed in such a manner that the proportion of the orthoboric acid in terms of solid content was 9.4% by mass with respect to 100 parts by mass of the solid content of the polyvinyl alcohol.

Production of Recording Medium 61

A recording medium 61 was produced as in the recording medium 1, except that in the preparation of the first ink-receiving layer coating liquid 1 for the recording medium 1, the aqueous orthoboric acid solution having a solid content of 5% by mass was mixed in such a manner that the proportion of the orthoboric acid in terms of solid content was 1.5% by mass with respect to 100 parts by mass of the solid content of the polyvinyl alcohol.

Production of Recording Medium 62

A recording medium 62 was produced as in the recording medium 1, except that in the preparation of the first ink-receiving layer coating liquid 1 for the recording medium 1, the aqueous orthoboric acid solution having a solid content of 5% by mass was mixed in such a manner that the proportion of the orthoboric acid in terms of solid content was 7.7% by mass with respect to 100 parts by mass of the solid content of the polyvinyl alcohol.

Production of Recording Medium 63

A recording medium 63 was produced as in the recording medium 2, except that in the preparation of the first ink-receiving layer coating liquid 2 for the recording medium 2, the aqueous orthoboric acid solution having a solid content of 5% by mass was mixed in such a manner that the proportion of the orthoboric acid in terms of solid content was 1.7% by mass with respect to 100 parts by mass of the solid content of the polyvinyl alcohol.

Production of Recording Medium 64

A recording medium 64 was produced as in the recording medium 2, except that in the preparation of the first ink-receiving layer coating liquid 2 for the recording medium 2, the aqueous orthoboric acid solution having a solid content of 5% by mass was mixed in such a manner that the proportion of the orthoboric acid in terms of solid content was 7.7% by mass with respect to 100 parts by mass of the solid content of the polyvinyl alcohol.

Production of Recording Medium 65

A recording medium 65 was produced as in the recording medium 3, except that in the preparation of the first ink-receiving layer coating liquid 3 for the recording medium 3, the aqueous orthoboric acid solution having a solid content of 5% by mass was mixed in such a manner that the proportion of the orthoboric acid in terms of solid content was 1.6% by mass with respect to 100 parts by mass of the solid content of the polyvinyl alcohol.

Production of Recording Medium 66

A recording medium 66 was produced as in the recording medium 3, except that in the preparation of the first ink-receiving layer coating liquid 3 for the recording medium 3, the aqueous orthoboric acid solution having a solid content of 5% by mass was mixed in such a manner that the proportion of the orthoboric acid in terms of solid content was 7.6% by mass with respect to 100 parts by mass of the solid content of the polyvinyl alcohol.

Production of Recording Medium 67

A recording medium 67 was produced as in the recording medium 4, except that in the preparation of the first ink-receiving layer coating liquid 4 for the recording medium 4, the aqueous orthoboric acid solution having a solid content of 5% by mass was mixed in such a manner that the proportion of the orthoboric acid in terms of solid content was 1.7% by mass with respect to 100 parts by mass of the solid content of the polyvinyl alcohol.

Production of Recording Medium 68

A recording medium 68 was produced as in the recording medium 4, except that in the preparation of the first ink-receiving layer coating liquid 4 for the recording medium 4, the aqueous orthoboric acid solution having a solid content of 5% by mass was mixed in such a manner that the proportion of the orthoboric acid in terms of solid content was 7.8% by mass with respect to 100 parts by mass of the solid content of the polyvinyl alcohol. Tables 1 and 2 illustrate the compositions of the resulting recording media 1 to 68.

TABLE 1

| | | Second ink-receiving layer | | First ink-receiving layer | | Entire ink-receiving layer | | | |
|---|---|---|---|---|---|---|---|---|---|
| Example | Recording medium | Mass ratio of content of polyvinyl alcohol to content of inorganic particle | Mass ratio of content of boric acid to content of polyvinyl alcohol | Mass ratio of content of polyvinyl alcohol to content of inorganic particle | Mass ratio of content of boric acid to content of polyvinyl alcohol | Total thickness (μm) | Thickness of second ink-receiving layer (μm) | Thickness of first ink-receiving layer (μm) | Surface roughness Ra (μm) |
| 1 | 1 | 17.0% | 17.6% | 13.0% | 5.8% | 35.0 | 10.0 | 25.0 | 1.2 |
| 2 | 2 | 17.0% | 17.6% | 30.0% | 5.8% | 35.0 | 10.0 | 25.0 | 1.2 |
| 3 | 3 | 17.0% | 17.6% | 25.0% | 5.8% | 35.0 | 10.0 | 25.0 | 1.2 |
| 4 | 4 | 17.0% | 17.6% | 18.0% | 5.8% | 35.0 | 10.0 | 25.0 | 1.2 |
| 5 | 5 | 17.0% | 17.6% | 13.0% | 5.8% | 35.0 | 10.0 | 25.0 | 1.2 |
| 6 | 6 | 17.0% | 17.6% | 13.0% | 5.8% | 35.0 | 10.0 | 25.0 | 1.2 |
| 7 | 7 | 17.0% | 17.6% | 13.0% | 5.8% | 18.0 | 5.0 | 13.0 | 1.3 |
| 8 | 8 | 17.0% | 17.6% | 13.0% | 5.8% | 20.0 | 6.0 | 14.0 | 1.3 |
| 9 | 9 | 17.0% | 17.6% | 13.0% | 5.8% | 40.0 | 12.0 | 28.0 | 1.2 |
| 10 | 10 | 17.0% | 17.6% | 13.0% | 5.8% | 43.0 | 13.0 | 29.0 | 1.1 |
| 11 | 11 | 17.0% | 17.6% | 13.0% | 5.8% | 35.0 | 2.5 | 32.5 | 1.2 |
| 12 | 12 | 17.0% | 17.6% | 13.0% | 5.8% | 35.0 | 5.0 | 30.0 | 1.2 |
| 13 | 13 | 17.0% | 17.6% | 13.0% | 5.8% | 35.0 | 17.5 | 17.5 | 1.2 |
| 14 | 14 | 17.0% | 17.6% | 13.0% | 5.8% | 35.0 | 20.0 | 15.0 | 1.2 |
| 15 | 15 | 17.0% | 10.0% | 13.0% | 5.8% | 35.0 | 10.0 | 25.0 | 1.2 |
| 16 | 16 | 17.0% | 30.0% | 13.0% | 5.8% | 35.0 | 10.0 | 25.0 | 1.1 |
| 17 | 17 | 10.0% | 30.0% | 13.0% | 5.8% | 35.0 | 10.0 | 25.0 | 1.2 |
| 18 | 18 | 12.0% | 25.0% | 13.0% | 5.8% | 35.0 | 10.0 | 25.0 | 1.2 |
| 19 | 19 | 20.0% | 15.0% | 13.0% | 5.8% | 35.0 | 10.0 | 25.0 | 1.2 |
| 20 | 20 | 22.0% | 13.6% | 13.0% | 5.8% | 35.0 | 10.0 | 25.0 | 1.2 |
| 21 | 21 | 17.0% | 17.6% | 13.0% | 2.3% | 35.0 | 10.0 | 25.0 | 1.2 |
| 22 | 22 | 17.0% | 17.6% | 13.0% | 6.9% | 35.0 | 10.0 | 25.0 | 1.2 |
| 23 | 23 | 17.0% | 17.6% | 30.0% | 2.3% | 35.0 | 10.0 | 25.0 | 1.0 |
| 24 | 24 | 17.0% | 17.6% | 30.0% | 7.0% | 35.0 | 10.0 | 25.0 | 1.2 |
| 25 | 25 | 17.0% | 17.6% | 25.0% | 2.4% | 35.0 | 10.0 | 25.0 | 1.1 |
| 26 | 26 | 17.0% | 17.6% | 25.0% | 6.8% | 35.0 | 10.0 | 25.0 | 1.2 |
| 27 | 27 | 17.0% | 17.6% | 18.0% | 2.2% | 35.0 | 10.0 | 25.0 | 1.2 |
| 28 | 28 | 17.0% | 17.6% | 18.0% | 6.7% | 35.0 | 10.0 | 25.0 | 1.2 |
| 29 | 29 | 17.0% | 17.6% | 10.0% | 5.8% | 35.0 | 10.0 | 25.0 | 1.2 |
| 30 | 30 | 17.0% | 17.6% | 11.0% | 5.8% | 35.0 | 10.0 | 25.0 | 1.2 |
| 31 | 31 | 17.0% | 17.6% | 40.0% | 5.8% | 35.0 | 10.0 | 25.0 | 1.2 |
| 32 | 32 | 17.0% | 17.6% | 42.0% | 5.8% | 35.0 | 10.0 | 25.0 | 1.1 |
| 33 | 33 | 17.0% | 17.6% | 10.0% | 5.8% | 35.0 | 10.0 | 25.0 | 1.2 |
| 34 | 34 | 17.0% | 17.6% | 11.0% | 5.8% | 35.0 | 10.0 | 25.0 | 1.2 |
| 35 | 35 | 17.0% | 17.6% | 40.0% | 5.8% | 35.0 | 10.0 | 25.0 | 1.1 |
| 36 | 36 | 17.0% | 17.6% | 42.0% | 5.8% | 35.0 | 10.0 | 25.0 | 1.2 |
| 37 | 37 | 17.0% | 17.6% | 10.0% | 5.8% | 35.0 | 10.0 | 25.0 | 1.2 |
| 38 | 38 | 17.0% | 17.6% | 11.0% | 5.8% | 35.0 | 10.0 | 25.0 | 1.2 |
| 39 | 39 | 17.0% | 17.6% | 40.0% | 5.8% | 35.0 | 10.0 | 25.0 | 1.2 |
| 40 | 40 | 17.0% | 17.6% | 42.0% | 5.8% | 35.0 | 10.0 | 25.0 | 1.3 |
| 41 | 41 | 17.0% | 17.6% | 10.0% | 5.8% | 35.0 | 10.0 | 25.0 | 1.2 |
| 42 | 42 | 17.0% | 17.6% | 11.0% | 5.8% | 35.0 | 10.0 | 25.0 | 1.0 |
| 43 | 43 | 17.0% | 17.6% | 40.0% | 5.8% | 35.0 | 10.0 | 25.0 | 1.2 |
| 44 | 44 | 17.0% | 17.6% | 42.0% | 5.8% | 35.0 | 10.0 | 25.0 | 1.2 |
| 45 | 45 | 17.0% | 17.6% | 13.0% | 5.8% | 35.0 | 10.0 | 25.0 | 1.2 |
| 46 | 46 | 17.0% | 17.6% | 13.0% | 5.8% | 35.0 | 10.0 | 25.0 | 1.1 |
| 47 | 47 | 7.0% | 16.4% | 13.0% | 5.8% | 35.0 | 10.0 | 25.0 | 1.0 |
| 48 | 48 | 17.0% | 17.6% | 13.0% | 5.8% | 35.0 | 10.0 | 25.0 | 0.0 |
| 49 | 49 | 17.0% | 17.6% | 13.0% | 5.8% | 35.0 | 10.0 | 25.0 | 6.6 |

TABLE 2

| | | Second ink-receiving layer | | First ink-receiving layer | | Entire ink-receiving layer | | | |
|---|---|---|---|---|---|---|---|---|---|
| Comparative Example | Recording medium | Mass ratio of content of polyvinyl alcohol to content of inorganic particle | Mass ratio of content of boric acid to content of polyvinyl alcohol | Mass ratio of content of polyvinyl alcohol to content of inorganic particle | Mass ratio of content of boric acid to content of polyvinyl alcohol | Total thickness (μm) | Thickness of second ink-receiving layer (μm) | Thickness of first ink-receiving layer (μm) | Surface roughness Ra (μm) |
| 1 | 50 | 17.0% | 17.6% | 0.0% | 0.0% | 35.0 | 35.0 | 0.0 | 1.1 |
| 2 | 51 | 0.0% | 0.0% | 13.0% | 5.8% | 35.0 | 0.0 | 35.0 | 1.0 |
| 3 | 52 | 0.0% | 0.0% | 30.0% | 5.8% | 35.0 | 0.0 | 35.0 | 1.2 |

TABLE 2-continued

| Comparative Example | Recording medium | Second ink-receiving layer: Mass ratio of content of polyvinyl alcohol to content of inorganic particle | Second ink-receiving layer: Mass ratio of content of boric acid to content of polyvinyl alcohol | First ink-receiving layer: Mass ratio of content of polyvinyl alcohol to content of inorganic particle | First ink-receiving layer: Mass ratio of content of boric acid to content of polyvinyl alcohol | Entire ink-receiving layer: Total thickness (μm) | Entire ink-receiving layer: Thickness of second ink-receiving layer (μm) | Entire ink-receiving layer: Thickness of first ink-receiving layer (μm) | Entire ink-receiving layer: Surface roughness Ra (μm) |
|---|---|---|---|---|---|---|---|---|---|
| 4 | 53 | 0.0% | 0.0% | 25.0% | 5.8% | 35.0 | 0.0 | 35.0 | 1.2 |
| 5 | 54 | 0.0% | 0.0% | 25.0% | 5.8% | 35.0 | 0.0 | 35.0 | 1.2 |
| 6 | 55 | 13.0% | 8.8% | 7.0% | 16.4 | 35.0 | 10.0 | 25.0 | 1.2 |
| 7 | 56 | 17.0% | 0.0% | 13.0% | 0.0% | 35.0 | 10.0 | 25.0 | 1.1 |
| 8 | 57 | 17.0% | 17.6% | 13.0% | 0.0% | 35.0 | 10.0 | 25.0 | 1.2 |
| 9 | 58 | 17.0% | 0.0% | 13.0% | 5.8% | 35.0 | 10.0 | 25.0 | 1.2 |
| 10 | 59 | 17.0% | 32.4% | 13.0% | 5.8% | 35.0 | 10.0 | 25.0 | 1.0 |
| 11 | 60 | 17.0% | 9.4% | 13.0% | 5.8% | 35.0 | 10.0 | 25.0 | 1.2 |
| 12 | 61 | 17.0% | 17.6% | 13.0% | 1.5% | 35.0 | 10.0 | 25.0 | 1.2 |
| 13 | 62 | 17.0% | 17.6% | 13.0% | 7.7% | 35.0 | 10.0 | 25.0 | 1.0 |
| 14 | 63 | 17.0% | 17.6% | 30.0% | 1.7% | 35.0 | 10.0 | 25.0 | 1.2 |
| 15 | 64 | 17.0% | 17.6% | 30.0% | 7.7% | 35.0 | 10.0 | 25.0 | 1.3 |
| 16 | 65 | 17.0% | 17.6% | 25.0% | 1.6% | 35.0 | 10.0 | 25.0 | 1.2 |
| 17 | 66 | 17.0% | 17.6% | 25.0% | 7.6% | 35.0 | 10.0 | 25.0 | 1.2 |
| 18 | 67 | 17.0% | 17.6% | 18.0% | 1.7% | 35.0 | 10.0 | 25.0 | 1.1 |
| 19 | 68 | 17.0% | 17.6% | 18.0% | 7.8% | 35.0 | 10.0 | 25.0 | 1.0 |

Evaluation

Cracking after Coating

Surfaces of the ink-receiving layers of the resulting recording media were observed and evaluated on the basis of the following criteria. The evaluation results were described in Tables 3 and 4.

Evaluation Criteria

5: No crack is observed.

4: Tiny cracks invisible to the naked eye are observed.

3: Cracks visible to the naked eye are observed in some areas.

2: Many cracks visible to the naked eye are observed in the entire surface.

1: Numerous large cracks are observed, and the ink-receiving layer is partially detached from the support.

Resistance to Cracking by Folding

Each of the resulting recording media was formed into an A4-size sheet. A solid black image was formed on the entire recording surface with an inkjet printer (trade name: MP990, manufactured by CANON KABUSHIKI KAISHA). The printed recording medium was folded in the middle in such a manner that the printed surface was inwardly folded. A load of 500 kg was applied to the recording medium with a press for 5 minutes to make a crease. The opening and closing operation of the creased recording medium was performed 20 times. The creased portion was visually checked and evaluated on the basis of the following criteria.

Evaluation Criteria

5: No white streak is seen.

4: A white streak is slightly seen.

3: A white streak is somewhat seen.

2: A white streak is clearly seen.

1: A wide white streak is clearly seen.

Ink Absorbency

A solid green image was formed on the recording surface of each of the resulting recording media with an inkjet printer (trade name: MP990, manufactured by CANON KABUSHIKI KAISHA, print mode: Canon Photo Paper Gloss gold, no color correction). The printed portion was visually observed and evaluated on the basis of the following criteria.

Evaluation Criteria

5: The solid image has substantially no uneven portion.

4: The solid image has only a few uneven portions.

3: The solid image has few uneven portions.

2: The solid image has many uneven portions.

1: Ink overflows on the solid image.

Optical Density

A solid black image was formed on the recording surface of each of the resulting recording media with an inkjet printer (trade name: MP990, manufactured by CANON KABUSHIKI KAISHA, print mode: Canon Photo Paper Gloss gold, no color correction). The optical density of the solid image was measured with an optical reflection densitometer (trade name: 530 spectrodensitometer, manufactured by X-Rite).

Evaluation Criteria

5: 2.20 or more

4: 2.15 or more and less than 2.20

3: 2.10 or more and less than 2.15

2: 2.00 or more and less than 2.10

1: less than 2.00

The foregoing evaluation results are described in Tables 3 and 4.

TABLE 3

| Example | Recording medium | Evaluation: Cracking after coating | Evaluation: Resistance to cracking by folding | Evaluation: Ink absorbency | Evaluation: Optical density |
|---|---|---|---|---|---|
| 1 | 1 | 5 | 5 | 5 | 5 |
| 2 | 2 | 5 | 4 | 5 | 4 |
| 3 | 3 | 5 | 4 | 5 | 4 |
| 4 | 4 | 5 | 4 | 5 | 4 |
| 5 | 5 | 5 | 4 | 5 | 4 |
| 6 | 6 | 5 | 4 | 5 | 4 |
| 7 | 7 | 5 | 5 | 3 | 3 |
| 8 | 8 | 5 | 5 | 4 | 4 |
| 9 | 9 | 4 | 4 | 5 | 5 |
| 10 | 10 | 3 | 3 | 5 | 5 |
| 11 | 11 | 5 | 5 | 3 | 4 |
| 12 | 12 | 5 | 5 | 4 | 4 |

TABLE 3-continued

| Example | Recording medium | Evaluation: Cracking after coating | Resistance to cracking by folding | Ink absorbency | Optical density |
|---|---|---|---|---|---|
| 13 | 13 | 5 | 4 | 5 | 5 |
| 14 | 14 | 4 | 3 | 5 | 5 |
| 15 | 15 | 4 | 5 | 3 | 5 |
| 16 | 16 | 5 | 3 | 5 | 5 |
| 17 | 17 | 3 | 3 | 5 | 5 |
| 18 | 18 | 4 | 4 | 5 | 5 |
| 19 | 19 | 5 | 5 | 4 | 5 |
| 20 | 20 | 5 | 5 | 3 | 4 |
| 21 | 21 | 3 | 5 | 4 | 5 |
| 22 | 22 | 5 | 3 | 5 | 5 |
| 23 | 23 | 3 | 4 | 3 | 4 |
| 24 | 24 | 5 | 3 | 4 | 4 |
| 25 | 25 | 3 | 4 | 3 | 4 |
| 26 | 26 | 5 | 3 | 4 | 4 |
| 27 | 27 | 3 | 4 | 4 | 4 |
| 28 | 28 | 5 | 3 | 5 | 4 |
| 29 | 29 | 3 | 3 | 5 | 5 |
| 30 | 30 | 4 | 4 | 5 | 5 |
| 31 | 31 | 5 | 5 | 4 | 5 |
| 32 | 32 | 5 | 5 | 3 | 4 |
| 33 | 33 | 3 | 3 | 4 | 4 |
| 34 | 34 | 4 | 4 | 5 | 4 |
| 35 | 35 | 5 | 5 | 4 | 4 |
| 36 | 36 | 5 | 5 | 3 | 4 |
| 37 | 37 | 3 | 3 | 5 | 4 |
| 38 | 38 | 4 | 4 | 5 | 4 |
| 39 | 39 | 5 | 5 | 4 | 4 |
| 40 | 40 | 5 | 5 | 3 | 3 |
| 41 | 41 | 3 | 3 | 5 | 4 |
| 42 | 42 | 4 | 4 | 5 | 4 |
| 43 | 43 | 5 | 5 | 4 | 4 |
| 44 | 44 | 5 | 5 | 3 | 3 |
| 45 | 45 | 3 | 3 | 5 | 5 |
| 46 | 46 | 3 | 3 | 5 | 4 |
| 47 | 47 | 5 | 3 | 5 | 4 |
| 48 | 48 | 5 | 4 | 5 | 5 |
| 49 | 49 | 3 | 4 | 5 | 5 |

TABLE 4

| Comparative Example | Recording medium | Evaluation: Cracking after coating | Resistance to cracking by folding | Ink absorbency | Optical density |
|---|---|---|---|---|---|
| 1 | 50 | 1 | 1 | 5 | 5 |
| 2 | 51 | 5 | 5 | 2 | 2 |
| 3 | 52 | 5 | 4 | 1 | 2 |
| 4 | 53 | 5 | 4 | 1 | 1 |
| 5 | 54 | 5 | 4 | 2 | 2 |
| 6 | 55 | 5 | 1 | 1 | 2 |
| 7 | 56 | 1 | 2 | 1 | 3 |
| 8 | 57 | 1 | 2 | 2 | 3 |
| 9 | 58 | 2 | 2 | 2 | 3 |
| 10 | 59 | 5 | 2 | 5 | 5 |
| 11 | 60 | 3 | 5 | 2 | 4 |
| 12 | 61 | 2 | 2 | 2 | 4 |
| 13 | 62 | 5 | 2 | 5 | 5 |
| 14 | 63 | 1 | 2 | 3 | 3 |
| 15 | 64 | 5 | 1 | 5 | 4 |
| 16 | 65 | 2 | 2 | 3 | 3 |
| 17 | 66 | 5 | 1 | 5 | 4 |
| 18 | 67 | 2 | 2 | 3 | 4 |
| 19 | 68 | 5 | 1 | 5 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-237516 filed Oct. 28, 2011, which is hereby incorporated by reference herein in its entirety.

What is claimed is:

1. A recording medium comprising, in sequence:

a support;

a first ink-receiving layer; and a second ink-receiving layer, wherein the first ink-receiving layer contains at least one selected from an alumina, an alumina hydrate, and a fumed silica, a polyvinyl alcohol, and a boric acid, wherein a mass ratio of a content of the boric acid in the first ink-receiving layer to a content of the polyvinyl alcohol in the first ink-receiving layer is 2.0% by mass or more and 7.0% by mass or less, wherein the second ink-receiving layer contains a fumed silica, a polyvinyl alcohol, and a boric acid, and wherein a mass ratio of a content of the boric acid in the second ink-receiving layer to a content of the polyvinyl alcohol in the second ink-receiving layer is 10.0% by mass or more and 30.0% by mass or less.

2. The recording medium according to claim 1, wherein a mass ratio of the content of the polyvinyl alcohol in the first ink-receiving layer to a total content of the alumina, the alumina hydrate, and the fumed silica is 11.0% by mass or more and 40.0% by mass or less.

3. The recording medium according to claim 1, wherein a mass ratio of the content of the polyvinyl alcohol in the second ink-receiving layer to a content of the fumed silica in the second ink-receiving layer is 12.0% by mass to 20.0% by mass.

4. The recording medium according to claim 1, wherein a total thickness of the first ink-receiving layer and the second ink-receiving layer is 30.0 μm or more and 38.0 μm or less.

5. The recording medium according to claim 4, wherein a thickness of the second ink-receiving layer is 7.0 μm or more and 15.0 μm or less.

6. The recording medium according to claim 1, wherein the mass ratio of the content of the polyvinyl alcohol in the first ink-receiving layer to the total content of the alumina, the alumina hydrate, and the fumed silica is 12.0% by mass or more and 30.0% by mass or less, and wherein the mass ratio of the content of the polyvinyl alcohol in the second ink-receiving layer to the content of the fumed silica in the second ink-receiving layer is 13.0% by mass or more and 18.0% by mass or less.

7. A recording medium comprising, in sequence:

a support;

a first ink-receiving layer; and a second ink-receiving layer, wherein the first ink-receiving layer contains at least one selected from an alumina, an alumina hydrate, and a fumed silica, a polyvinyl alcohol, and a boron material which is at least one selected from orthoboric acid, metaboric acid, hypoboric acid, orthoborates, orthoborate hydrates, diborates, diborate hydrates, metaborates, metaborate hydrates, tetraborates, tetraborate hydrates, pentaborates, and pentaborate hydrates, wherein a mass ratio of a content of the boron material in the first ink-receiving layer to a content of the polyvinyl alcohol in the first ink-receiving layer is 2.0% by mass or more and 7.0% by mass or less, wherein the second ink-receiving layer contains a fumed silica, a polyvinyl alcohol, and a boron material which is at least one selected from orthoboric acid, metaboric acid, hypoboric acid, orthoborates, orthoborate hydrates, diborates, diborate hydrates, metaborates, metaborate hydrates, tetraborates, tetraborate hydrates, pentaborates, and pentaborate hydrates, and wherein a mass ratio of a content of the boron material in the second ink-receiving layer to a content of the polyvinyl alcohol in the second ink-receiving layer is 10.0% by mass or more and 30.0% by mass or less.

8. The recording medium according to claim 7, wherein the boron material in the first ink-receiving layer is orthoboric acid, and wherein the boron material in the second ink-receiving layer is orthoboric acid.

* * * * *